US005314862A

United States Patent [19]

Hirota et al.

[11] Patent Number: 5,314,862

[45] Date of Patent: May 24, 1994

[54] THERMAL TRANSFER RECORDING SHEET

[75] Inventors: Takao Hirota, Machida; Hideo Shinohara; Katsuhiko Kuroda, both of Yokohama, all of Japan

[73] Assignee: Mitsubishi Kasei Corporation, Tokyo, Japan

[21] Appl. No.: 974,896

[22] Filed: Nov. 12, 1992

[30] Foreign Application Priority Data

Nov. 15, 1991 [JP] Japan ..... 3-300753

[51] Int. Cl.[5] ..... B41M 5/035; B41M 5/38

[52] U.S. Cl. ..... 503/227; 428/195; 428/207; 428/500; 428/522; 428/913; 428/914

[58] Field of Search ..... 8/471; 428/195, 913, 428/914, 500, 522; 503/227

[56] References Cited

FOREIGN PATENT DOCUMENTS 0257633 3/1988 European Pat. Off. .
0333873 9/1989 European Pat. Off. .
60-19138 1/1985 Japan .
60-203494 10/1985 Japan ..... 503/227
61-86289 5/1986 Japan .
61-274990 12/1986 Japan .
63-170091 7/1988 Japan .
2-80291 3/1990 Japan .

OTHER PUBLICATIONS

Patents Abstracts of Japan, vol. 12, No. 190 (M-704), Jun. 3, 1988, JP-A-62 297 184, Dec. 24, 1987.

*Primary Examiner*—B. Hamilton Hess
*Attorney, Agent, or Firm*—Oblon, Spivak, McClelland, Maier & Neustadt

[57] ABSTRACT

A thermal transfer recording sheet comprising a substrate and an image-receiving layer formed thereon, which is thermally transferable onto a record sheet, wherein the image-receiving layer comprises a transparent receptive layer and a white opacifying layer laminated in this order on the substrate, and the opacifying layer contains a plasticizer.

11 Claims, 1 Drawing Sheet

THERMAL TRANSFER RECORDING SHEET

Figure 1:
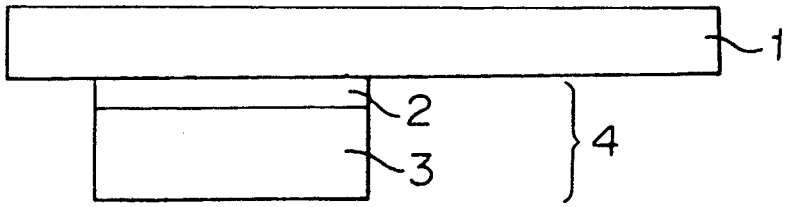

The present invention relates to a thermal transfer recording sheet. Particularly, it relates to a thermal transfer recording sheet, whereby an ordinary sheet of paper can be used as a record sheet.

As a thermal transfer recording method, a method is well known and commonly used wherein a thermal transfer recording sheet having an ink layer containing a colorant and an image-receiving sheet having an image-receiving layer to receive the colorant are overlaid one on the other so that the respective layers will be face to face, and the thermal transfer recording sheet is heated from its rear side by a heating means such as a thermal head so that the colorant is transferred to the image-receiving sheet. However, by this recording method, the record sheet is restricted to a specific image-receiving sheet having a specific image-receiving layer, and it has been rather difficult to utilize such a method from the viewpoint of the convenience and the costs.

Under these circumstances, a sublimation-type transfer recording sheet has been proposed (e.g. Japanese Unexamined Patent Publication No. 86289/1986) wherein a thermally transferable image-receiving layer is formed on a sublimation-type transfer recording sheet, and the thermally transferable image-receiving layer is thermally melt-transferred from the substrate of the thermal transfer recording sheet to a record sheet, and then the ink or the colorant is transferred from the ink layer to the image-receiving layer, whereby an ordinary sheet of paper can be used as the record sheet.

Further, the present inventors have previously proposed a structure wherein a white opacifying layer and a transparent receptive layer are sequentially laminated to form a thermal transfer image-receiving layer in order to overcome a difficulty that when an ordinary sheet of paper is used as a record sheet, reproducibility of the color of an image is poor since the whiteness is inadequate (Japanese Patent Application No. 100063/1991).

In a case where an ordinary sheet of paper which is commercially available, is used as a record sheet without using such special sheet, firstly, the thermally melt-transferable image-receiving layer is melt-transferred from the substrate of the thermal transfer recording sheet onto the ordinary sheet of paper. However, the conventional opacifying layer has difficulties such that the adhesion to the ordinary sheet of paper is inadequate, and edges of the transferred image-forming layer as between the heated portion and non heated portion, are not sharp. The present invention is intended to provide a thermal transfer recording sheet which is capable of solving such problems.

Namely, it is an object of the present invention to provide a thermal transfer recording sheet capable of transferring a clear image simply and with excellent color reproducibility on a wide range of various types of ordinary sheets of paper.

Another object of the present invention is to provide a thermal transfer recording sheet having a thermally transferable image-receiving layer having excellent adhesiveness with a wide range of various types of ordinary sheets of paper.

A still further object of the present invention is to provide a thermal transfer recording sheet which is capable of presenting sharp boundaries (sharp edges) between the heated portion and the non-heated portion at the time of thermal transfer of the image-receiving layer.

Such objects of the present invention can be accomplished by a thermal transfer recording sheet comprising a substrate and an image-receiving layer formed thereon, which is thermally transferable onto a record sheet, wherein the image-receiving layer comprises a transparent receptive layer and a white opacifying layer laminated in this order on the substrate, and the opacifying layer contains a plasticizer.

It is known to incorporate a certain specific plasticizer to an ink-receptive layer to increase the density of transferred colorant (Japanese Unexamined Patent Publications No. 274990/1986, No. 19138/1985 and No. 80291/1990, European Patent Publication 0257633, which corresponds to U.S. Pat. No. 5,116,148 and applicants' Japanese Patent Applications No. 116814/1991, No. 116815/1991 and No. 116816/1991 (which corresponds to U.S. patent application Ser. No. 07/868,655)). However, the techniques disclosed in these publications are directed to a structure wherein a plasticizer is incorporated to an colorant-receptive layer of an image-receiving layer, and they are intended to improve the transferability and fixing of the colorant. Whereas, the present invention is directed to a structure wherein a plasticizer is incorporated to the white opacifying layer wherein white pigments are included and not to recept the colorant, and it is intended to improve the sharpness of the edges of the image-forming layer between the heated portion and the non-heated portion at the time of the thermal transfer or to improve the adhesion upon the transfer. Thus, the present invention is distinctly different from the known techniques in its construction and the effects thereby obtained.

In the accompanying drawings:

FIG. 1 is an enlarged view of a portion of a thermal transfer recording sheet of the present invention where an image-receiving layer is provided, wherein reference numeral 1 indicates a substrate, numeral 2 indicates a transparent receptive layer, numeral 3 indicates a white opacifying layer, and numeral 4 indicates an image-receiving layer.

Figure 2:
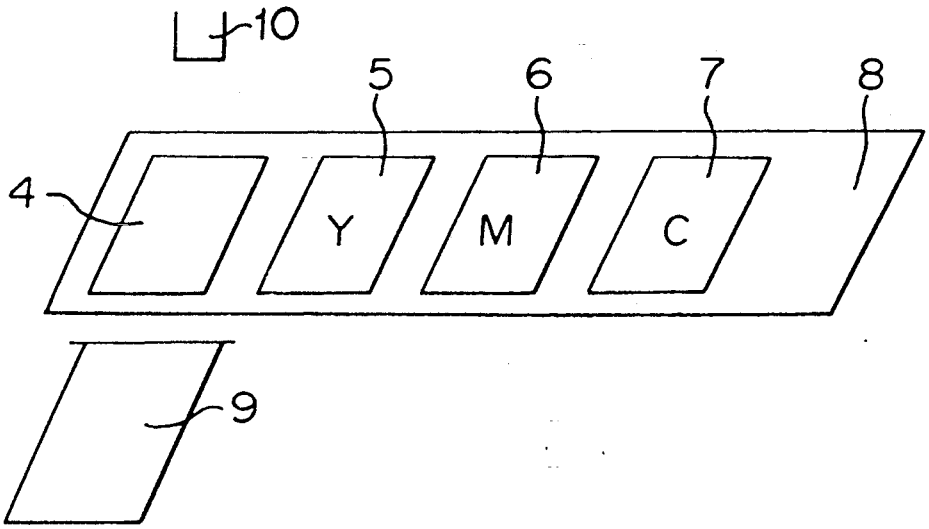

FIG. 2 is a view illustrating an embodiment of the thermal transfer recording sheet of the present invention, wherein reference numeral 4 indicates an image-receiving layer, numeral 5 indicates an yellow ink layer, numeral 6 indicates a magenta ink layer, numeral 7 indicates a cyan ink layer, numeral 8 indicates a thermal transfer recording sheet, numeral 9 indicates a record sheet, and numeral 10 indicates a heat-applying means such as a thermal head.

Now, the present invention will be described in detail with reference to the preferred embodiments.

The white opacifying layer of the present invention comprises a white pigment, a binder resin and a plasticizer, and the blend ratios of the white pigment, the binder and the plasticizer are such that relative to 1 part by weight of the white pigment, the binder is from 0.1 to 20 parts by weight, preferably from 0.5 to 5 parts by weight, and the plasticizer is from 0.01 to 10 parts by weight, preferably from 0.05 to 2.5 parts by weight.

Further, the plasticizer is usually from 0.02 to 0.50 part by weight, preferably from 0.02 to 0.30 part by weight, more preferably from 0.02 to 0.20 part by weight, relative to 1 part by weight of the binder resin.

The plasticizer useful for the present invention may, for example, be a phthalate such as dimethyl phthalate, dibutyl phthalate or dioctyl phthalate, a dibasic acid ester such as dioctyl adipate, dibutyl sebacate, dioctyl sebacate, diisostearyl adipate or ditridecyloctyl adipate, a fatty acid ester such as behenic monoglyceride, octyl behenate or octyldodecyl myristate, or an epoxy compound such as epoxidized soybean oil or octyl epoxy stearate.

Among them, a dibasic acid ester made of an alcohol component having at least 12 carbon atoms and a dibasic acid component is particularly preferred, since it is excellent in the stability of the image after the image transfer. The alcohol component having at least 12 carbon atoms may, for example, be dodecyl alcohol, myristyl alcohol, hexadecyl alcohol, stearyl alcohol, isostearyl alcohol, behenyl alcohol, octyldodecyl alcohol or tridecyloctyl alcohol. The dibasic acid component may, for example, be adipic acid, sebacic acid or phthalic acid. Particularly preferred is an ester made of a $C_{18-32}$ alcohol and an aliphatic dibasic acid.

Further, the plasticizer of the present invention is preferably the one having a high level of compatibility when combined with a binder resin for the white opacifying layer. Specifically, it is preferred to select a plasticizer having a solubility parameter closest to the solubility parameter of the binder resin.

However, in the present invention, for the purpose of minimizing the influence over the dye forming the image, it is preferred to select the binder resin and the plasticizer so that the respective solubility parameters satisfy the relation represented by the following formula.

$$\text{Dye} > \text{Binder resin} \geqq \text{Plasticizer}$$

As the binder resin, a resin commonly known as a thermoplastic resin may be employed, such as a saturated polyester resin, a vinyl acetate resin, an acrylic resin, a methacrylic resin, a styrene resin, a polycarbonate resin, a vinyl chloride resin, a polyvinyl acetal resin or a vinyl chloride-vinyl acetate copolymer resin. Among them, a vinyl chloride resin, a polyvinyl acetal resin or a vinyl chloride-vinyl acetate copolymer resin is particularly preferred.

The white pigment may, for example, be titanium oxide, zinc oxide, calcium carbonate, talc or clay. Further, for the purpose of supplementing the whiteness, various fluorescent brighteners may effectively be incorporated.

As the resin useful for the transparent receptive layer of the present invention, a resin dyeable with a sublimable or heat-diffusible dye may be mentioned, such as a saturated polyester, an acrylic resin, a methacrylic resin, a styrene resin, a polycarbonate resin, a cellulose acetate, a polyvinyl acetal resin, a polyvinyl phenylacetal resin, a vinyl chloride resin, a vinyl chloride-vinyl acetate copolymer resin, a polyarylate resin, an AS resin or crosslinked products of the above resins.

As shown in FIG. 1, in the present invention, the image-receiving layer basically has a double layer structure wherein a transparent receptive layer and then a white opacifying layer are sequentially laminated in this order on the substrate. However, the present invention is not limited to this specific embodiment, and another layer may further be provided for some purpose or as the case requires, for example, between the substrate and the transparent receptive layer, or between the transparent receptive layer and the white opacifying layer, or on the surface of the white opacifying layer. In order to facilitate peeling of the image-receiving layer from the substrate at the time of the thermal transfer, it is effective to provide a prime-coating layer of a releasing agent such as a silicone-type, ketone-type or polyvinyl acetal-type releasing agent on the substrate surface.

The method for forming the image-receiving layer of the present invention may be optionally selected from commonly employed methods. For example, a wet-on-wet coating method by means of a reverse roll coater, a gravure coater, a rod coater, an air doctor coater or a die coater (for the details of these methods, see "Coating Systems" edited by Yuji Harasaki, published by Maki Shoten in 1977). Particularly preferred is two plate coating by a gravure printing system.

As the substrate, a sheet of e.g. polyester or polyamide which is commonly used as a substrate for thermal transfer recording sheets of this type, is suitably used.

The thickness of the transparent receptive layer formed on the substrate is usually from 0.1 to 20 μm, preferably from 1 to 10 μm, more preferably from 1 to 6 μm.

The thickness of the white opacifying layer is preferably thick for the purposes of reducing formation irregularities of an ordinary sheet of paper used as a record sheet and opacifying a yellowish ground color. However, there is a limitation from the coating process, and the thickness is usually from 0.5 to 20 μm, preferably from 3 to 12 μm as a dried film thickness.

The thickness of the white opacifying layer is preferably at least 1.5 times, usually from 1.5 to 6 times the thickness of the transparent receptive layer.

As the sublimable or heat diffusible dyes to be used for the ink layer of thermal transfer recording in combination with the image receiving layer of the present invention, various nonionic dyes such as azo dyes, anthraquinone dyes, nitro dyes, styryl dyes, naphthoquinone dyes, quinophthalone dyes, azomethine dyes, cumalin dyes and condensed polycyclic dyes may be used.

Further, in the present invention, it is possible to employ a thermally melt transfer ink layer, and conventional inks and binders may be used in a suitable combination.

When the thermal transfer recording sheet of the present invention is used, the record sheet is not particularly limited, and it may be a usual sheet of paper made of common cellulose fibers.

Thermal transfer recording employing the thermal transfer recording sheet of the present invention is conducted in such a manner that firstly, the image-receiving layer is partially or entirely thermally transferred from the substrate onto an ordinary sheet of paper, and then an ink layer is transferred to the image-receiving layer by heating by a heating means such as a thermal head.

The thermal transfer recording sheet of the present invention may be of the type shown in FIG. 2 wherein a white opacifying layer and a transparent receptive layer are laminated on the same substrate to form an image-receiving layer, and ink layers of yellow (Y), magenta (M) and cyan (C) are formed adjacent thereto.

According to this arrangement, both the image-receiving layer and the ink layers are integral with the thermal transfer recording sheet, whereby no extra operation is required, and it is readily possible to limit the image-receiving layer to be transferred onto the ordinary sheet of paper to the image-portion. However, the present invention is not limited to such a specific embodiment, and the image-receiving layer may be entirely transferred. Further, using a sheet having only an image-receiving layer coated on a substrate with a prime-coating layer interposed according to the present invention and a separate color sheet having ink layers in combination, transfer of the image-receiving layer and transfer of an image can be conducted by separate operations. Thus, the thermal transfer recording sheet of the present invention includes various types as described above.

Now, the present invention will be described in further detail with reference to Examples. However, it should be understood that the present invention is by no means restricted by such specific Examples.

EXAMPLE 1

(a) Preparation of an image-receiving layer

A coating solution (R-1) for a transparent receptive layer comprising 20 parts by weight of a vinyl chloride-vinyl acetate copolymer resin (UCRA-VYHD, tradename, manufactured by Union Carbide Company), 60 parts by weight of toluene and 1.0 part by weight of an amino-modified silicone (KF-393, tradename, manufactured by Shinetsu Chemical Co., Ltd.) as a releasing agent, and a coating solution (R-2) for a white opacifying layer comprising 15 parts by weight of a vinyl chloride-vinyl acetate copolymer resin (UCRA-VYLF, tradename, manufactured by Union Carbide Company), 15 parts by weight of titanium oxide (R-580, manufactured by Ishihara Sangyo Kabushiki Kaisha), 1 part by weight of dioctyl phthalate and 60 parts by weight of toluene, were wet-on-wet coated by a gravure printing machine on a bi-axially stretched polyethylene terephthalate film (4.5 mm in thickness) having heat resistant lubricating treatment applied to the rear side of the ink-coating surface, in the order to form the structure as shown in FIG. 1, to form an image-receiving layer having a total dried film thickness of 15 mm (transparent receptive layer: 5 μm, white opacifying layer: 10 μm).

(b) Preparation of ink layers

Adjacent to the above image-receiving layer, the following three different color coating solutions were coated in the order as shown in FIG. 2 and dried to form ink layers each having a dried film thickness of about 1 μm.

Coating solution for a yellow ink layer: a coating solution (C-1) comprising 5 parts by weight of a yellow dye of the following structural formula (A), 10 parts by weight of a phenoxy resin (PKHJ, tradename, manufactured by Union Carbide Company), 90 parts by weight of methyl ethyl ketone and 10 parts by weight of isopropanol:

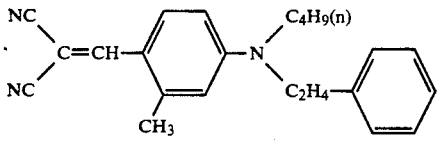

(A)

Coating solution for a magenta ink layer: a coating solution (C-2) comprising 5 parts by weight of a magenta dye of the following structural formula (B), 10 parts by weight of a phenoxy resin, 90 parts by weight of methyl ehtyl ketone and 10 parts by weight of isopropanol:

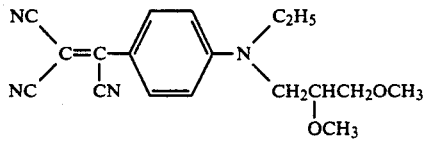

(B)

Coating solution for a cyan ink layer: a coating solution (C-3) comprising 5 parts by weight of a cyan dye of the following structural formula (C), 10 parts by weight of a phenoxy resin, 90 parts by weight of methyl ethyl ketone and 10 parts by weight of isopropanol:

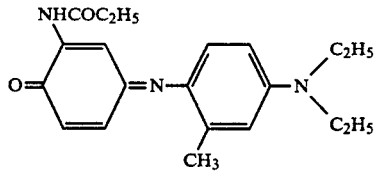

(C)

(c) Transfer recording test

The above sublimation-type thermal transfer recording sheet was put on a high quality paper sheet having a weight of 200 g (manufactured by Kanzaki Seishi K.K.) so that the ink coating surface was in contact with the high quality paper sheet, and recording was conducted under the following conditions using a partially glazed line thermal head having a heat generating resistor density of 5.4 dots/mm, whereupon the transfer characteristics were compared, and the results are shown in Table 1.

Recorded line density: 5.4 lines/mm

Electric power applied to the thermal head: 0.20 W

Pulse width applied to the thermal head:

During transfer of the image-receiving layer: (a) 14.5 m/sec (b) 10.0 m/sec

During transfer of the image: 0–14.5 m/sec

EXAMPLE 2

A test was conducted in the same manner as in Example 1 except that in the white opacifying layer used in Example 1, 3 parts by weight of octyldodecyl myristate was used instead of dioctyl phthalate as the plasticizer, and the results are shown in Table 1.

EXAMPLE 3

A test was conducted in the same manner as in Example 1 except that in the white opacifying layer used in Example 1, an acrylic resin (Dianal BR-117, tradename, manufactured by Mitsubishi Rayon Company Ltd.) was used instead of the vinyl chloride-vinyl acetate copolymer resin as the binder resin, and the results are shown in Table 1.

COMPARATIVE EXAMPLE 1

A test was conducted in the same manner as in Example 1 except that in the white opacifying layer used in Example 1, no plasticizer was used, and the results are shown in Table 1.

COMPARATIVE EXAMPLE 2

A test was conducted in the same manner as in Example 3 except that in the white opacifying layer used in Example 3, no plasticizer was used, and the results are shown in Table 1.

TABLE 1

| | White opacifying layer | | | | | |
|---|---|---|---|---|---|---|
| | Binder resin A | Plasticizer B | White pigment C | Blend ratio A/B/C | Transfer characteristic of the image-receiving layer | Adhesion of the image-receiving layer |
| Example 1 | Vinyl chloride-vinyl-acetate copolymer resin | Dioctyl phthalate | Titanium oxide | 15/1/15 | Good | Good |
| Example 2 | Vinyl chloride-vinyl-acetate copolymer resin | Octyldodecyl myristate | Titanium oxide | 15/3/15 | Good | Good |
| Example 3 | Acrylic resin | Dioctyl phthalate | Titanium oxide | 15/1/15 | Good | Good |
| Comparative Example 1 | Vinyl chloride-vinyl-acetate copolymer resin | — | Titanium oxide | 15/0/15 | Poor edging | Poor adhesion |
| Comparative Example 2 | Acrylic resin | — | Titanium | 15/0/15 | Poor edging | Good |

EXAMPLE 4

A transfer recording test (C) was conducted in the same manner as in Example 1 except that in the white opacifying layer used in Example 1, 1 part by weight of diisostearyl adipate was used instead of the dioctyl phthalate as the plasticizer, the dried film thickness of the transparent receptive layer was changed to 2 μm and the dried film thickness of the white opacifying layer was changed to 6 μm. Further, the following image stability evaluation test (d) was conducted. The results are shown in Table 2.

(d) Image stability evaluation test

A printed sample obtained by the above transfer recording test was held in a constant temperature and constant humidity chamber maintained at a temperature of 60° C. under a relative humidity of 60% for two weeks, whereupon the presence or absence of shading off along the edges of the image was visually determined.

EXAMPLE 5

Tests were conducted in the same manner as in Example except that in the white opacifying layer used in Example 4, 1 part of ditridecyloctyl adipate was used instead of diisostearyl adipate as the plasticizer, and the results are shown in Table 2.

EXAMPLE 6

Tests were conducted in the same manner as in Example 4 except that in the white opacifying layer used in Example 4, an acrylic resin (Dianal BR-107, tradename, manufactured by Mitsubishi Rayon Company Ltd.) was used instead of the vinyl chloride-vinyl acetate copolymer resin as the binder resin, and the results are shown in Table 2.

TABLE 2

| | White opacifying layer | | | | | | |
|---|---|---|---|---|---|---|---|
| | Binder resin A | Plasticizer B | White pigment C | Blend ratio A/B/C | Transfer characteristic of the image-receiving layer | Adhesion of the image-receiving layer | Image stability |
| Example 4 | Vinyl chloride-vinyl-acetate copolymer resin (VYLF) | Diisostearyl adipate | Titanium oxide | 15/1/15 | Good | Good | Good |
| Example 5 | Vinyl chloride-vinyl-acetate copolymer resin (VYLF) | Ditridecyl-octyl adipate | Titanium oxide | 15/1/15 | Good | Good | Good |
| Example 6 | Acrylic resin (BR-107) | Diisostearyl adipate | Titanium oxide | 15/1/15 | Good | Good | Good |

The thermal transfer recording sheet of the present invention shows excellent adhesive properties to a wide range of ordinary sheets of paper and presents an excellent transferred record image with sharp edges of the transferred image-receiving layer.

It is capable of forming a clear image with excellent color reproducibility without being influenced by the color of paper even when an ordinary sheet of paper having a high yellow component and being poor in the whiteness, is used.

Further, the transparent receptive layer does not contain a white pigment in itself, whereby an image having a high density with profound deepness can be obtained.

We claim:

1. A thermal transfer recording sheet comprising a substrate and an image-receiving layer formed thereon, which is thermally transferable onto a record sheet, wherein the image-receiving layer comprises a transparent receptive layer and a white opacifying layer laminated in this order on the substrate, said opacifying layer comprising one part by weight of a white pigment, from 0.1 to 20 parts by weight of a binder resin and from 0.01 to 10 parts by weight of a plasticizer.

2. The thermal transfer recording sheet according to claim 1, wherein the plasticizer is a compound selected from the group consisting of phthalic acid esters, dibasic acid esters, fatty acid esters and epoxy compounds.

3. The thermal transfer recording sheet according to claim 1, wherein the plasticizer is a compound selected from the group consisting of dimethyl phthalate, dibutyl phthalate, dioctyl phthalate, dioctyl adipate, dibutyl sebacate, dioctyl sebacase, diisostearyl adipate, ditridecyloctyl adipate, behenic acid monoglyceride, octyl behenate, octyldodecyl myristate, epoxidized soybean oil and octylepoxy distearate.

4. The thermal transfer recording sheet according to claim 1, wherein the plasticizer is a dibasic acid ester made of an alcohol component having at least 12 carbon atoms and a dibasic acid component.

5. The thermal transfer recording sheet according to claim 1, wherein the plasticizer is an ester compound made of a $C_{18-32}$ alcohol component and an aliphatic dibasic acid component.

6. The thermal transfer recording sheet according to claim 1 in the plasticizer is an ester compound made of an alcohol component selected from the group consisting of dodecyl alcohol, myristyl alcohol, hexadecyl alcohol, stearyl alcohol, isostearyl alcohol, behenyl alcohol, octyldodecyl alcohol and tridecyloctyl alcohol, and a dibasic acid component selected from the group consisting of adipic acid, sebacic acid and phthalic acid.

7. The thermal transfer recording sheet according to claim 1, wherein the plasticizer is diisostearyl adipate or ditridecyloctyl adipate.

8. The thermal transfer recording sheet according to claim 1, wherein the white opacifying layer contains titanium oxide as a white pigment.

9. The thermal transfer recording sheet according to claim 1, wherein the white opacifying layer contains a vinyl chloride-vinyl acetate copolymer resin or an acrylic resin as a binder resin.

10. The thermal transfer recording sheet according to claim 1, wherein the image-receiving layer has a prime-coating layer containing releasing agent between the substrate and the transparent receptive layer.

11. The thermal transfer recording sheet according to claim 1, wherein an ink layer containing a sublimable or heat-transferable dye is formed on the substrate provided with the thermally transferable image-receiving layer.

* * * * *